US005181719A

United States Patent [19]

Cleveland, III

[11] Patent Number: 5,181,719

[45] Date of Patent: Jan. 26, 1993

[54] TARGET

[76] Inventor: Novie P. Cleveland, III, 433 Rotterdam Rd., Easley, S.C. 29640

[21] Appl. No.: 779,807

[22] Filed: Oct. 21, 1991

[51] Int. Cl.[5] ..... F41J 1/00

[52] U.S. Cl. ..... 273/409

[58] Field of Search ..... 273/409, 403

[56] References Cited

U.S. PATENT DOCUMENTS

| | | | |
|---|---|---|---|
| 2,362,512 | 11/1944 | Waldmann | 273/403 |
| 3,370,852 | 2/1968 | Kandel | 273/378 |
| 3,504,913 | 4/1970 | Bilotti | 273/409 X |
| 3,895,803 | 7/1975 | Coe | 273/378 |
| 3,899,175 | 8/1975 | Loe | 273/378 |
| 4,032,679 | 6/1977 | Aoyagi | 283/18 X |
| 4,244,586 | 1/1981 | Gorrow | 273/409 |
| 4,550,683 | 11/1985 | Jones | 118/505 |

*Primary Examiner*—William H. Grieb
*Attorney, Agent, or Firm*—Cort Flint

[57] ABSTRACT

A target kit for improving the ease and accuracy of sighting in a telescopic sight which comprises a substantially rigid and self supporting sheet having a target face. Also, a package containing a plurality of sheets, each containing progressively sized die-cut concentric sighting frames having adhesive on one face for individually securing selected sighting frames of varying size to the target face. This provides a precise, compatible format for creating sight pictures. A stand connecting with the rigid sheet is also provided. The stand acts to position the rigid sheet in an upright position. Securing means including a first securing means provided on the rigid sheet and second and third securing means provided on the stand. The kit also includes a package of hole patches for covering previous shot patterns.

25 Claims, 2 Drawing Sheets

TARGET

FIELD OF THE INVENTION

This invention is directed to a target particularly suitable for use with firearms such as hand guns and rifles with or without telescopic sights. The target includes a rigid self-supporting sheet having a target face to which may be attached one or a plurality of sighting elements.

BACKGROUND OF THE INVENTION

Firearms used for hunting or target shooting must be "sighted-in" for selected distances in order to enable accurate shot placement. Traditional targets using a bulls eye having progressively enlarged circles thereround were designed for use with open or peep sights and are not particularly suitable for sighting-in telescopic sights. Also, conventional targets are designed for specific distances. When selecting various ones of these distances, an individual target is necessary for each distance selected. Most conventional targets are not selfsupporting. They are usually made of paper and must be attached to something in order that they remain upright.

The traditional black bulls eye of a conventional target does not provide an optimum sight picture which assists in obtaining a precise evaluation for the sighting in of a telescopic sight. Because a precise sight picture is not obtained, the precise adjustment necessary to bring a shot pattern to the bulls eye becomes extremely difficult to bring about. This is because very little contrast on the target is provided for use with the sighting device or fixture of a telescopic sight.

U.S. Pat. No. 4,244,586 is directed to a sighting in target which includes a target face having vertical and horizontal grid lines. Arranged centrally of the target is a dark colored cross having dark concentric rings formed at four ends thereof. This target is intended to sight in a telescoped rifle for long range shots while the actual sighting in is done at short range.

The patent does not provide plural randomly available sighting elements. The patent also fails to utilize precise and contrasting lines on the target face which may be utilized to align the horizontal and vertical telescope sight lines and to determine the distance between the point of aim and the point of impact.

Adhesive coated sheets of various sizes and shapes are in themselves not new as illustrated by U.S. Pat. Nos. 4,032,679 and 4,550,683. These patents are not concerned with target faces which assist sighting in by providing sighting surfaces of contrasting colors.

It is an object of the invention to provide a target system which overcomes all of the above shortcomings.

An object of the invention is to provide a target which is practical, precise, and convenient.

Another object of the invention is to provide a target which utilizes a plurality of sighting elements either singularly or in combinations of various sizes.

Another object of the invention is to provide stick-on, multi-sized, square-shaped, sighting elements which present a center of contrasting color.

Another object of the invention is to provide a target system which accommodates all variables (distance, scope, magnification, etc.).

Another object of the invention is to provide a target arrangement which includes a stand for maintaining the target face in an upright position.

Another object of the invention is a target arrangement which provides an indication of precise telescope adjustment for sighting in.

Another object of the invention is to provide a target kit which contains all of the essentials for target shooting.

Another object of the invention is to provide a target kit which includes various sized sighting elements and a plurality of shot repair members.

SUMMARY OF THE INVENTION

A target arrangement including a laminated sheet construction which is adapted to be secured onto a target surface for placing multi-sized, open center sighting elements thereon. The sheet construction comprising a plurality of progressively sized die-cut concentric sighting frames having inner and outer edges and which have an adhesive on one surface thereof so that they may be selectively secured to the target surface. Each sighting frame consists of a square open center of a selected size surrounded by a dark colored border area of a width which is of a lesser size. The target surface consists of a self-supporting, substantially rigid sheet with one surface having a white background, covered by a plurality of vertical and horizontal grid lines forming equal sized squares. The grid lines are of a color corresponding with the referred to dark color. The sighting frames are of a size which allows one of the inner and outer edges to be aligned with vertical and horizontal grid lines forming the squares. This arrangement allows for a vertical grid line to be aligned with a vertical edge of the sighting frame and a horizontal grid line to be aligned with a horizontal edge of the sighting frame when secured to the target surface so as to create a precise sight picture. A plurality of sighting frames may simultaneously be secured to the target surface in random arrangements. The rigid sheet is formed of a corrugated paper sheet or a corrugated plastic sheet.

Each sighting frame is provided with a vertical and a horizontal index line arranged centrally across each frame edge face. The index lines are white which corresponds with the background. These lines are located to be aligned with a vertical and horizontal grid line so that lines which contrast with the background are presented. The combination of lines provide reference points which correspond with sighting lines of a rifle scope and allow the sighting frame to be indexed to the grid of the target surface.

The dark color of the sighting frame should not be glossy but may be a pastel or flat red, black, or orange, which could also be fluorescent.

The square open centers are sized in one inch increments and at least certain of the border areas are one-half inch in width.

The rigid sheet is provided with a first interlocking means adapted to interlock with a support stand. The target surface may be thus held in an upright position. The support stand consists of a foldable sheet of corrugated paper having a second interlocking means which cooperate with the first interlocking means to support the target surface in position. These interlocking means consist of transverse vertical slots which are between one and two inches in length. The stand includes a generally planar base and a pair of side members arranged to extend vertically from the base. The second interlocking means is arranged in the side members.

A target kit for improving the ease and accuracy of sighting in a telescopic sight which comprises a substantially rigid and self supporting sheet having a target face. Also included is a package containing a plurality of sheets, each containing progressively sized, die-cut, concentric sighting frames having adhesive on one face for individually securing the sighting frames to the target face. This provides precise sighting pictures of varying sizes for the target face. A stand connecting with the rigid sheet is also provided. The stand acts to position the rigid sheet in an upright position. Securing means including a first securing means which are provided on the rigid sheet, and second and third securing means provided on the stand. The kit further includes a package of hole patches for covering previous shot patterns.

The target face consists of a white background having equally spaced vertical and horizontal grid lines arranged thereon. The grid lines are spaced at one inch intervals to form one inch squares over the entire target face.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
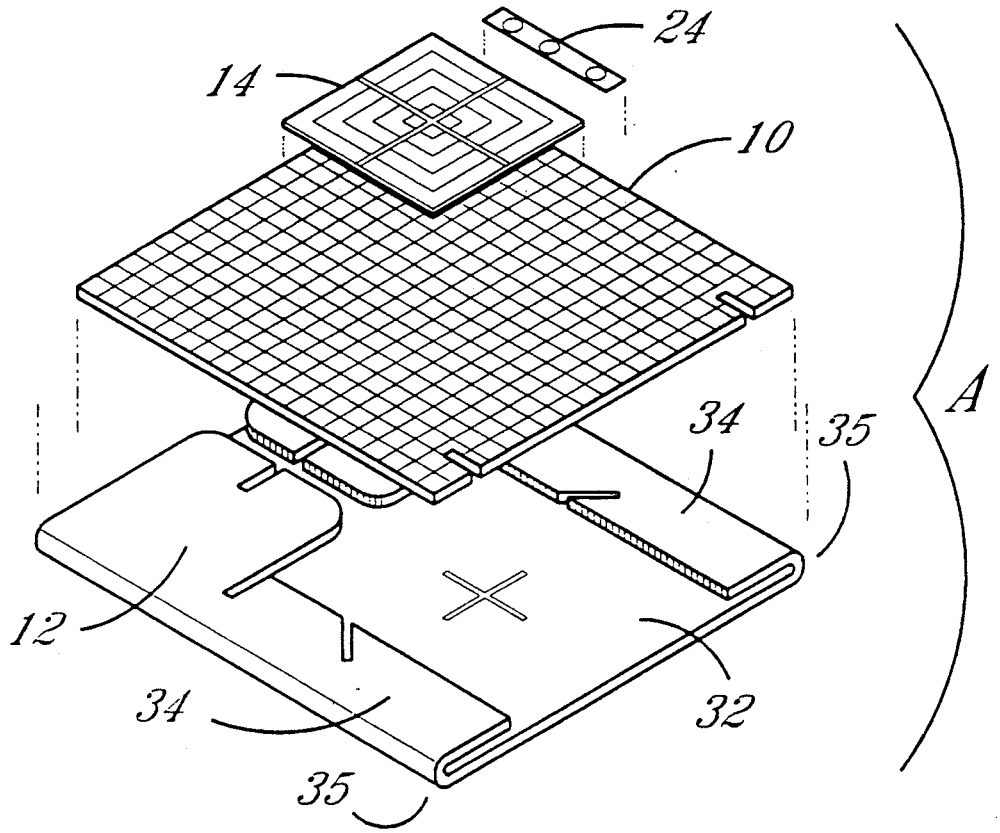
FIG. 1 is an exploded perspective view of the target kit.
Figure 2:
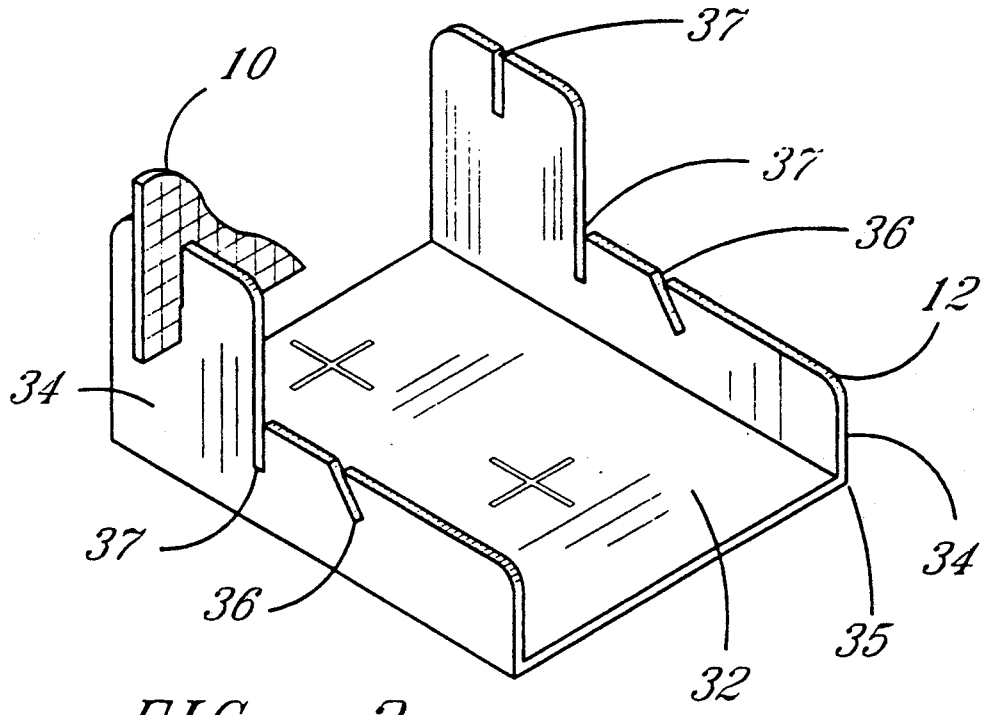
FIG. 2 is a sectional perspective view of the target and stand in operative position.
Figure 3:
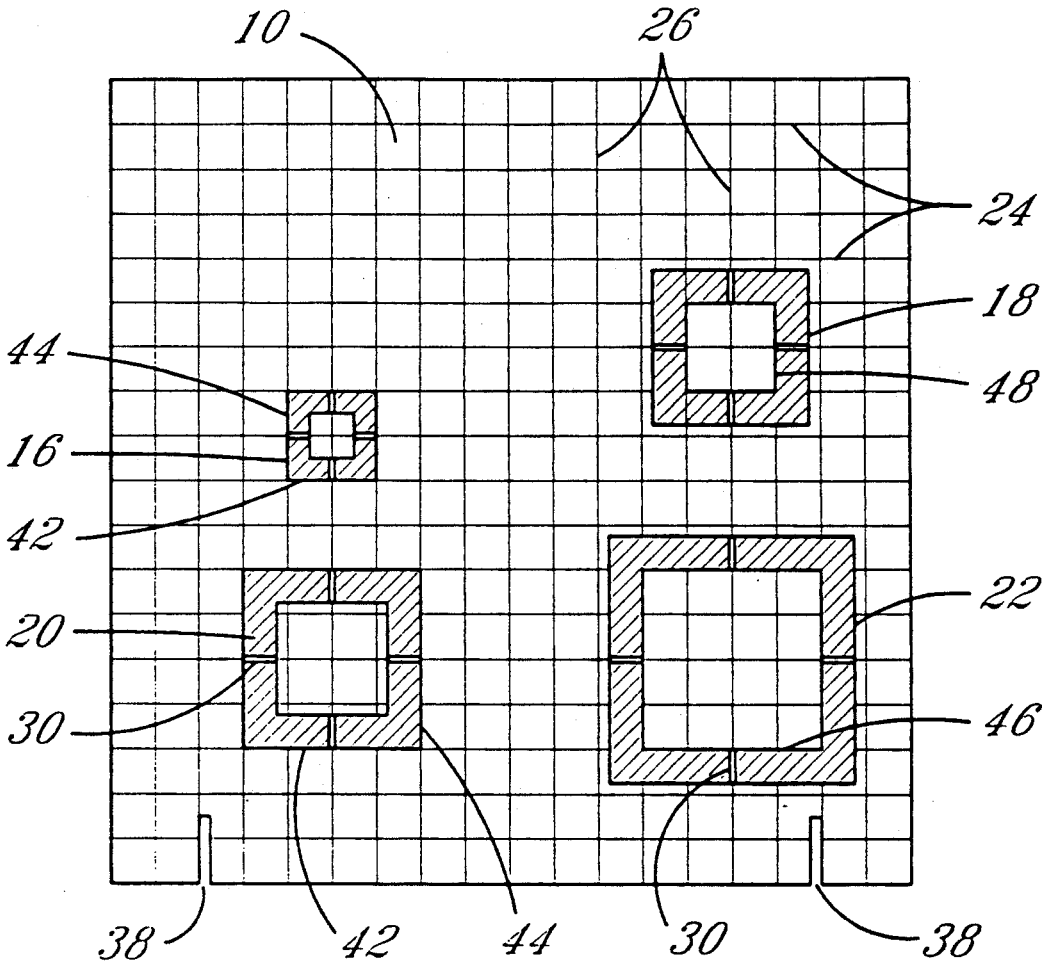
FIG. 3 is a frontal view of the target face having a plurality of sighting elements arranged thereon.
Figure 4:
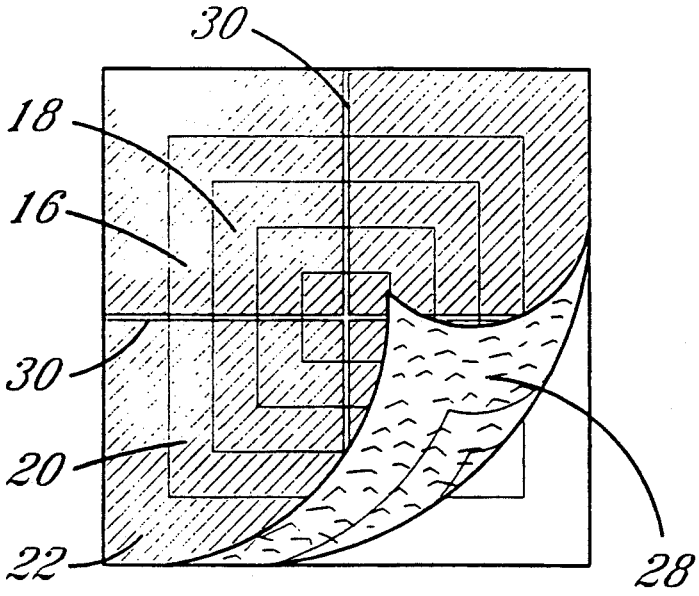
FIG. 4 is a frontal view of the sheet of sighting frames with the covering paper lining removed.
Figure 5:
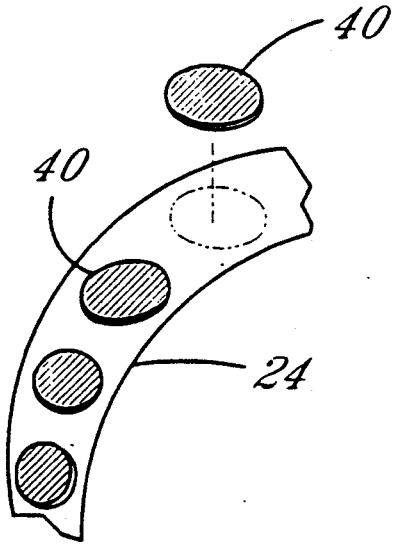
FIG. 5 is a top view of the shot patch strip.

Referring now to the drawings there is illustrated in FIG. 1 a target kit A containing target sheet 10, target stand 12, a package 14 containing approximately four sheets B each containing a plurality of progressively die-cut sighting frames 16, 18, 20, 22. Kit A also includes a package of hole patches 24. Target kit A provides all of the essentials necessary to accurately, precisely and easily sight in a telescoped or iron sighted firearm including an instructional brochure.

Target sheet 10 is formed of corrugated material, either paper or plastic, which is sufficiently rigid so as to be self-standing. This eliminates the need of providing some type of backing from which the target hangs. One face of sheet 10 is colored white with a plurality of equally spaced dark colored horizontal and vertical lines 24, 26 forming a plurality of squares over the entire face. This face is hereinafter referred to as the target surface. Target sheet 10 is preferably eighteen inches by eighteen inches, although its size could be larger or smaller. Also, the target sheet could be rectangular.

Horizontal and vertical lines 24, 26 form one inch squares over the entire target face. Here again, the squares may be slightly larger or smaller so long as they are of equal size. Lines 24, 26 are preferably black, either pastel or fluorescent. Red and orange, also pastel or fluorescent, have also proven to be satisfactory colors. Sheets B are laminated on one surface with an adhesive. A covering sheet 28, which peels away, is provided so that sheets B may be easily stored while awaiting use. Sheets B are die-cut to form a plurality of square sighting frames 16, 18, 20, 22. The frames are cut so that frame 16 has a one inch square center, frame 18 a two inch square center, frame 20 a three inch square center and frame 22 a four inch square center. The border area of each frame is at least one-half inch wide, although the border for frame 22 is preferably three-fourths inch wide. This is because the larger the frame, the more distant the target is normally placed. The larger border area simply further assists in providing a proper contrasting sight area.

Each border is provided at its center with a transverse white index line 30. The purpose of the index lines will be fully set forth hereinafter.

Stand 12 is formed of the same corrugated material as target sheet 10. It consists of a base portion 32 and a pair of side members 34 which fold along lines 35 into a position which is substantially perpendicular to the base portion. The upper edge of each side portion is two-tiered with the upper tier being approximately seven inches high and the lower tier being approximately four inches high. Locking means 37, consisting of a pair of slots, are formed in each tier to extend at approximately ninety degrees to base 32. The lower tier also includes a pair of diagonal slots 36, which are arranged at approximately forty-five degrees to base 32. Slots 37, 36 are approximately one and one-eighth inches deep and one-eighth inch wide.

One edge of target sheet 10 has a pair of slots 38 which are equal in size with slots 37, 36.

Slots 38 of sheet 10 fit into a selected pair of slots 37, 36 to firmly position the sheet in a vertical position. Slots 36 are provided for those times when the ground is not flat. The stand may be at an angle to the horizontal but target sheet 10 can still be arranged to extend vertically.

Hole patches 24 consist of round pieces of laminated paper 40 colored to match the edge portions of sighting frames 16, 18, 20, 22 or being white to match the color of the target face of target sheet 10.

When sighting in, the shooter fires a pattern. Generally, several patterns must be fired before the telescope is adjusted to an accurate position. The round hole patches 40 are used to cover the holes of a shot pattern so that the location of the holes of a subsequent pattern may accurately and easily be located and not confused with previous holes.

In practice, target sheet 10 is arranged in a vertical position. A sighting frame is selected and secured to the face of sheet 10. The sighting frames 16 and 20 are sized so that their outer vertical and horizontal edges 42, 44 extend along vertical and horizontal lines 24, 26. Sighting frames 18 and 22 are sized so that their inner vertical and horizontal lines 46, 48 extend along the vertical and horizontal lines 24, 26. All target frames are arranged on sheet 10 so that a vertical line 26 crosses a horizontal line 24 at the center of the opening of the sighting frame. Index lines 30 are aligned with these horizontal and vertical lines so that the frame is properly indexed with lines 24, 26 in a condition that continuous lines pass horizontally and vertically through the target area. These lines coincide with and therefore may easily be aligned with the cross lines of a telescopic sight so that the rifle may be quickly and accurately aimed. Because of the sharp contrast of the colors, dark on white, the lines are easily visible.

When a shot pattern is fired, it can easily be determined where, relative to the sighting frame, they struck the target sheet. Because of the uniform squares which cover target sheet 10, the number of inches above, below, left, or right which the shot pattern is off center is easily determined. The telescope is adjusted with vertical clicks and horizontal clicks. It can easily be determined how many clicks represent an inch at a given distance. Knowing this, to sight in the telescope merely requires counting the number of vertical and horizontal squares the pattern is off center and applying the appropriate number of vertical and horizontal clicks.

The invention has been described as being particularly suitable for use with firearms it is noted that the disclosed target arrangement is also suitable for use with other types of sports such as archery.

While a preferred embodiment of the invention has been described using specific terms, such description is for illustrative purposes only, and it is to be understood that changes and variations may be made without departing from the spirit or scope of the following claims.

What is claimed is:

1. A targeting arrangement comprising:

a target surface;

a laminated sheet comprising;

a plurality of progressively sized die-cut concentric sighting frames which have an adhesive on one surface thereof and are adapted to be selectively removed and secured to said target surface;

each said sighting frame consists of a dark colored border area having inner and outer edges, said inner edges forming a square open center of a selected size and said outer edges forming the perimeter of said frame;

said target surface consisting of a self-supporting substantially rigid sheet with one surface having a contrasting background with a plurality of vertical and horizontal grid lines arranged thereon forming equal sized squares over the entire said one surface, said grid lines being of a color corresponding to said dark color and said sighting frames and being of a size which allows one of said inner and outer edges to be aligned with said vertical and horizontal grid lines, whereby;

when a selected sighting frame is secured to said one surface a vertical grid line is aligned with a pair of vertical edges of said sighting frame and a horizontal grid line is aligned with a pair of horizontal edges of said sighting frame creating a precise sight picture.

2. The device of claim 1 wherein said rigid sheet comprises a corrugated paper sheet.

3. The device of claim 1 wherein said rigid sheet comprises a corrugated plastic sheet.

4. The arrangement of claim 1 wherein each sighting frame is provided with a vertical and a horizontal index line arranged centrally across each frame side, said index lines providing reference points which correspond with grid lines of a said target surface thereby enabling said sighting frame to be accurately indexed with said grid lines.

5. The arrangement of claim 4 wherein said alignment lines are white and correspond with said background.

6. The arrangement of claim 1 wherein said dark color is flat and comprises one of pastel red, black, or orange, or fluorescent red, black, or orange.

7. The arrangement of claim 1 wherein said square open centers are sized in one inch increments and said border areas are at least one-half inch in width.

8. The arrangement of claim 1 wherein a plurality of said sight frames may be simultaneously and randomly arranged on said target surface.

9. The arrangement of claim 1 wherein said rigid sheet is provided with first interlocking means which are adapted to interlock with a support stand whereby said target surface may be held in an upright position.

10. The arrangement of claim 9 wherein said stand consists of a foldable corrugated sheet having second interlocking means which cooperate with said first interlocking means to support said target surface in said upright position.

11. The arrangement of claim 10 wherein said first and second interlocking means consist of transverse slots.

12. The arrangement of claim 11 wherein said slots are between one and two inches in length.

13. The arrangement of claim 10 wherein said stand includes a generally planar base having a pair of side members arranged to extend vertically from said base, said second interlocking means are arranged in said side members.

14. The arrangement of claim 13 wherein said second interlocking means includes a pair of slots arranged transversely of said planar base and a pair of slots arranged at substantially 45° of said planar base.

15. A target kit for improving the ease and accuracy of zeroing in a telescopic sight of a firearm which comprises:

a substantially rigid and self supporting sheet having a target face;

a package containing a plurality of adhesive coated sheets, each containing progressively sized die-cut concentric sighting frames having said adhesive on one face for securing said sighting frames to said target face, whereby;

precise sighting pictures of varying sizes may be created on said target face.

16. The kit of claim 15 which further includes a stand having means for connecting with said rigid sheet whereby said rigid sheet may be maintained in an upright position.

17. The kit of claim 16 wherein a pair of first connecting means are provided on said rigid sheet for connecting with a second and third pair of connecting means provided on said stand.

18. The kit of claim 17 wherein said second pair of connecting means are arranged diagonally of said third pair of connecting means.

19. The kit of claim 15 which further includes a package of hole patches for covering previous shot patterns.

20. The kit of claim 15 wherein said target face consists of a white background having equally spaced vertical and horizontal grid lines arranged thereon.

21. The kit of claim 15 wherein said grid lines are spaced at one inch intervals.

22. The kit of claim 15 wherein said sighting frames are provided with vertical and horizontal alignment lines.

23. A targeting arrangement including:

a target surface;

a laminated sighting frame sheet adapted to be secured to said target surface;

said target surface consisting of a self-supporting substantially rigid sheet with one surface having a contrasting background with a plurality of vertical and horizontal grid lines arranged thereon forming equal sized squares over the entire said one surface, said grid lines being of a color corresponding to said dark color and said sighting frames and being of a size which allows one of said inner and outer edges to be aligned with said vertical and horizontal grid lines;

said sheet construction comprising:

a plurality of progressively sized die-cut concentric sighting frames which have an adhesive on one surface thereof and are adapted to be selectively removed and secured to said target surface; and each said sighting frame consists of a dark colored border area having inner and outer edges, said inner edges forming a square open center of a selected size and said outer edges forming the perimeter of said frame;

a pair of vertical and horizontal index lines are arranged to extend across each border area of said sighting frame;

whereby, when a selected sighting frame is secured to said one surface a vertical grid line is aligned with a pair of vertical index lines of said sighting frame and a horizontal grid line is aligned with a pair of horizontal index lines of said sighting frame so as to accurately index said sighting frame with said grid lines.

24. The arrangement of claim 23 wherein said alignment lines are white and correspond with said background.

25. The arrangement of claim 23 wherein said square open centers are sized in one inch increments and said border areas are at least one-half inch in width.

* * * * *